United States Patent [19]

Marforio

[11] 4,067,272

[45] Jan. 10, 1978

[54] DEVICE FOR STACKING ARTICLES OF CLOTHING IN A SEWING UNIT

[75] Inventor: Nerino Marforio, Milan, Italy

[73] Assignee: Rockwell-Rimoldi S.p.A., Milan, Italy

[21] Appl. No.: 727,876

[22] Filed: Sept. 29, 1976

[30] Foreign Application Priority Data

Oct. 2, 1975 Italy ..... 27871/75

[51] Int. Cl.[2] ..... D05B 33/00

[52] U.S. Cl. ..... 112/121.29; 271/175

[58] Field of Search ..... 112/121.29, 121.15, 112/121.11; 271/175

[56] References Cited

U.S. PATENT DOCUMENTS

| | | | |
|---|---|---|---|
| 3,704,884 | 12/1972 | Nicolay et al. | 271/175 |
| 3,788,248 | 1/1974 | Marforio | 112/121.29 |
| 3,965,831 | 6/1976 | Weir | 112/121.15 |

FOREIGN PATENT DOCUMENTS

| | | | |
|---|---|---|---|
| 1,345,141 | 1/1974 | United Kingdom | 271/175 |

*Primary Examiner*—Werner H. Schroeder
*Assistant Examiner*—Peter Nerbun

[57] ABSTRACT

A garment stacking device in which a plurality of garments are stacked in a vertical position over a stacking bar in which a thrust element is provided to cooperate with the other elements of the stacking device to hold the lower ends of the stacked garments free of the zone where a newly inserted end is to fall from each succeeding garment being stacked.

4 Claims, 5 Drawing Figures

A

DEVICE FOR STACKING ARTICLES OF CLOTHING IN A SEWING UNIT

BACKGROUND OF THE INVENTION

1. Field of the Invention.

The present invention relates to a device for stacking articles of clothing in a sewing unit and, more particularly, for articles of clothing to which accessories such as pockets etc. have been applied.

2. Description of the Prior Art.

The known types of stacking devices currently in use usually include a thruster element which is adapted to engage and move an article of clothing, which has just been sewn and which is decending from the work surface of the sewing unit, against a fixed stacking bar. These stacking devices include means for draping the article of clothing over the stacking bar, and a clamping means adapted to hold the articles of clothing against the stacking bar when the thruster element is situated in the retracted rest position.

With regard to articles of clothing to which accessories such as pockets etc. have been applied, the capacity of the conventional stacking devices is limited in that the available space between the stacking bar and the thruster element becomes greatly reduced as the articles are stacked on the bar due to the fact that the ends of the articles provided with the the aforementioned additional parts are inserted into this space.

SUMMARY OF THE INVENTION

An object of the present invention is to obviate the above disadvantage and to provide a stacking device capable of receiving the same number of articles of clothing irrespective of whether the garments are provided with additional pieces or not.

To attain this object, the technical problem to be solved is that of displacing the ends of the articles of clothing provided with the additional parts from the zone into which they are caused to decend.

This technical problem is solved by a stacking device that includes a thrust element which is disposed beneath a fixed stacking bar and which is movable in one direction to a position in back of the article of clothing to be stacked and in the opposite direction so as to move the article to a position spaced from the descent zone which is effective in maintaining this zone clear during the decending movement of each garment.

The stacking device according to the present invention offers the advantage of being able to stack a larger number of garments provided with added elements sewn thereto than the conventional devices since those portions of the garments with the added elements are moved towards the stacking bar in such a way as to provide an unrestricted space into which the articles of clothing are caused to decend when leaving the work surface of the sewing unit.

Other objects, features and advantages of the present invention will be made apparent in the following description thereof which is provided with reference to the accompanying drawings in which:

DESCRIPTION OF THE PREFERRED EMBODIMENT

Figures 1, 2, 3, 4, 5:
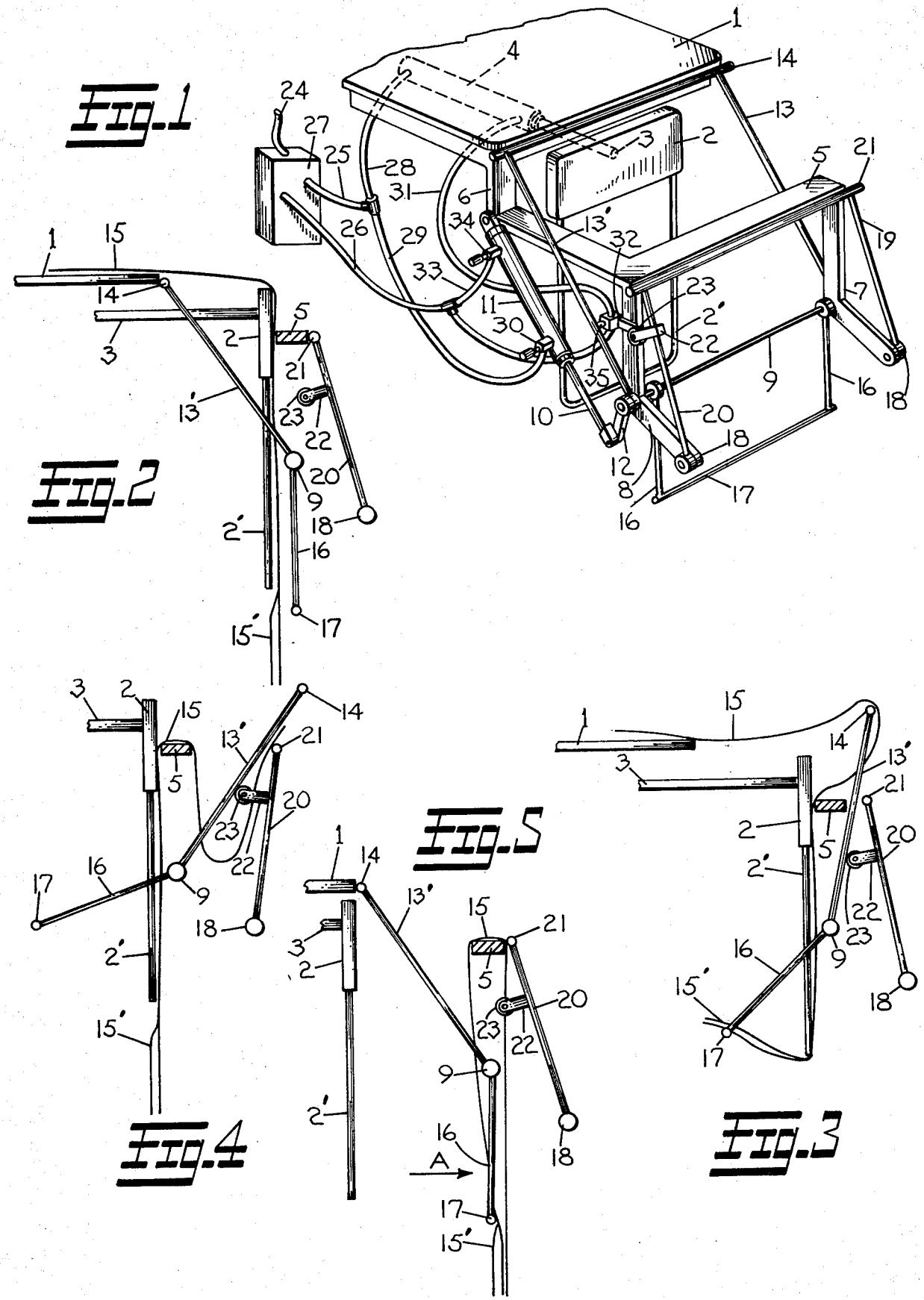
FIG. 1 is a perspective view of the stacking device according to the invention.
FIGS. 2, 3, 4 and 5 illustrate the different operating stages of the device shown in FIG. 1.

FIG. 1 shows the stacking device according to the invention attached to the work surface 1 of a conventional sewing unit (not shown). The device includes a plate 2, having a depending auxiliary bar 2'. The plate 2 is operatively connected to a piston rod 3 of a dual action pneumatic cylinder 4 that is fixed beneath the work surface 1.

The plate 2 is adapted to be moved in a horizontal direction from a position beneath the work surface 1 to a position of engagement with a fixed stacking bar 5 that is attached to the work surface 1 by means of a bracket 6. A pair of spaced arms 7 and 8 are attached to and depend from the underside of the fixed stacking bar 5. An oscillatably mounted shaft 9 traverses the distance between the arms 7 and 8 and the ends thereof are journaled in aligned openings (not shown) disposed intermediate the ends of said arms. This shaft 9 is actuated by means of a piston rod 10 of a dual action pneumatic cylinder 11 and a lever 12 the latter of which interconnects said shaft 9 with the piston rod.

As shown in FIG. 1, the ends of a pair of rods 13 and 13' are fixed to shaft 9 in contiguous relation with arms 7 and 8 respectively. These rods 13 and 13' extend generally upwardly and are interconnected at their upper ends by means of a bar 14. This bar 14 provides the means for folding an article of clothing 15 received from the work surface 1 over the fixed stacking bar 5.

A pair of spaced arms 16 are also fixed to shaft 9 adjacent the opposed inner surface of arms 7 and 8 and extending generally downwardly their lower ends are interconnected by means of a bar 17. This bar 17 forms a thrust element disposed beneath the fixed stacking bar 5 and will be further described hereinafter. The space intermediate the arms 16 is greater than the width of the articles of clothing 15 to be stacked.

Referring again to FIG. 1, a pair of rods 19 and 20 are pivotally mounted on the lower ends 18 of arms 7 and 8 and extending generally upwardly their upper ends are interconnected with bar 21 constituting the clamping means adapted to hold the articles of clothing against the fixed stacking bar.

The bar 21 is biased toward the fixed stacking bar 5 by means of springs (not shown) which are located in the area of the ends 18 of the arms 7 and 8.

A support bracket 22 is assembled on rod 20 and carries a roller 23 which is adapted to be engaged by rod 13' when the latter is actuated to swing bar 14 for the purpose of folding an article of clothing 15. The pneumatic cylinders 4 and 11 are supplied with compressed air through a supply line 24 which, in turn, is interconnected to two feed lines or conduits 25 and 26. Interposed between the supply line 24 and the conduits 25 and 26 a metering valve 27 is provided which can, by suitable means, be manually or automatically controlled to selectively control the feed or compressed air to either conduit 25 or conduit 26.

The conduit 25 is connected by means of a conduit 28 to a chamber of the dual action pneumatic cylinder 4 and, by means of a conduit 29, to a volume regulator valve 30 which is connected to a chamber of the dual action pneumatic cylinder 11.

The conduit 26 is connected by means of the conduit 31 and a valve 32 to the other chamber of the pneumatic cylinder 4 and by means of the conduit 33 and a volume regulator valve 34 it is connected to the other chamber of the cylinder 11.

The valve 32 attached to the arm 8 includes an actuating element 35 that is adapted to be engaged by the rod 13' in a manner which will be more fully described hereinafter.

FIG. 1 represents the rest position of the device wherein the plate 2 is located in a position beneath the work surface 1 and the bar 14 is positioned in contact with the end of the work surface.

The stacking device according to the invention operates in the following manner. The article of clothing coming from the sewing unit at the end of its sliding movement on the work surface 1 moves downwardly through a descent zone over the bar 14 and along the face of the plate 2 which is facing toward the fixed bar 5. As the article of clothing 15 is being discharged from the sewing unit either an automatic means controlled by said unit or a manual means actuated by the operator causes the metering valve 27 to become operative and to direct air from the supply line 24 into the conduit 25 and then into the conduits 28 and 29. As a result, the plate 2 is rapidly moved toward the fixed stacking bar 5 in such a way that the article of clothing 15 becomes clamped between said plate 2 and the fixed stacking bar 5 (FIG. 2) as the bar 14 then begins to rotate about the shaft 9.

The bar 14 which begins its rotation after a predetermined amount of delay, which is accomplished by means of selective regulation of the two volume regulators 30 and 34, folds the article of clothing 15 over the fixed bar 5 as illustrated in FIG. 3. Rod 13' during its movement to rotate bar 14 engages the roller 23 to effect movement of the rod 20 and the bar 21 carried thereby in such a way as to pivot the latter away from the fixed stacking bar 5 and clear the space required by the article to be folded, such that the latter wraps itself over the fixed bar 5 (FIG. 4).

That portion of the article of clothing 15 which descends downwardly between the clamping surfaces of the plate 2 and the fixed bar 5 is disposed in close proximity with the auxiliary bar 2' over a specific distance, while the lower end thereof having a pocket 15' is moved by the oscillating bar 17, during the tilting movement of the bar 14 (FIG. 3), until the bar 17 passes beyond the lower end of the garment as shown in FIG. 4.

To accomplish the latter operation it is obviously necessary for the auxiliary bar 2' to be narrower than the bar 17 and to be located above the arcuated path through which said bar 17 is caused to travel.

At this point, the metering valve 17 automatically interrupts the feed of compressed air into the conduit 25 and directs it into the conduit 26 which directs it into the conduits 31 and 33. As a result, the cylinder 11 is actuated so as to cause the bar 14 to return to its initial position of engagement with the work surface 1.

The return movement of bar 14 to its initial position causes rod 13' to engage the actuating element 35 of the valve 32 so as to connect the conduit 31 to the other chamber of the cylinder 4 which is effective in causing the plate 2 to return to its position beneath the work surface 1.

However, before the bar 13' engages the actuating element 35, the bar 21 is in position to clamp the garment 15 against the fixed stacking bar 5 such that the garment is retained in a positive manner on said fixed bar 5.

As illustrated in FIG. 5, the return movement of the bar 14 to its initial position causes simultaneous movement of bar 17 so as to move the lower end of the stacked garments, which includes the pocket 15', in the direction of the arrow A to a position that is removed from the descent zone of the garments decending from the work surface, thereby keeping said zone clear as the garments accumulate on the fixed bar 5.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A garment stacking device for a sewing unit having a work surface along which a garment is advanced as it is sewn and from which it descends for reception by said stacking device, the improvement comprising:

a. a fixed stacking bar (5) attached in spaced relation to one end of said work surface;

b. a plate (2) mounted for reciprocating movement on the underside of the work surface for engaging and moving a garment descending from the latter into engagement with said stacking bar;

c. means (14) interconnected with said stacking bar and movable between positions for engaging and folding that portion of a garment extending from the work surface over said stacking bar;

d. clamping means (21) operatively connected to said stacking bar for clamping a garment thereto after presentation by said folding means; and e. thrust means disposed beneath said fixed stacking bar and operatively connected to said folding means for moving the ends of the stacked garments furthest removed from said fixed stacking bar to a position spaced from the garment descent zone so as to maintain this zone clear during the descent of each successive garment.

2. The garment stacking device according to claim 1 wherein said device includes an oscillatably driven shaft (9) operatively connected to said thrust means and said engaging and folding means for effecting simultaneous actuation thereof.

3. The garment stacking device according to claim 2 wherein said thrust means defines a horizontally disposed bar member (17) supported for pivotal movement by and below said oscillatably driven shaft.

4. The garment stacking device according to claim 3 wherein said plate (2) includes a depending auxiliary bar (2') for locating the lower end of a descending garment in a location at which said bar member (17) can be pivoted to a position of engagement therewith so as to move the same clear of the descending zone.

* * * * *